US011482390B2

(12) United States Patent
Yang et al.

(10) Patent No.: US 11,482,390 B2
(45) Date of Patent: Oct. 25, 2022

(54) ARC-EXTINGUISHING DEVICE AND CIRCUIT BREAKER PROVIDED WITH SAME

(71) Applicant: SHANGHAI LIANGXIN ELECTRICAL CO., LTD, Shanghai (CN)

(72) Inventors: Yizheng Yang, Shanghai (CN); Gang Hu, Shanghai (CN); Wenxue Yang, Shanghai (CN); Yinfang Huang, Shanghai (CN); Shijia Zhu, Shanghai (CN)

(73) Assignee: SHANGHAI LIANGXIN ELECTRICAL CO., LTD, Shanghai (CN)

( * ) Notice: Subject to any disclaimer, the term of this patent is extended or adjusted under 35 U.S.C. 154(b) by 0 days.

(21) Appl. No.: 17/272,216

(22) PCT Filed: Mar. 13, 2019

(86) PCT No.: PCT/CN2019/077966
§ 371 (c)(1),
(2) Date: Feb. 26, 2021

(87) PCT Pub. No.: WO2020/098191
PCT Pub. Date: May 22, 2020

(65) Prior Publication Data

US 2021/0313128 A1 Oct. 7, 2021

(30) Foreign Application Priority Data

Nov. 13, 2018 (CN) ..... 201811347327.0

(51) Int. Cl.
*H01H 33/42* (2006.01)
*H01H 33/70* (2006.01)

(52) U.S. Cl.
CPC ..... *H01H 33/7015* (2013.01); *H01H 33/42* (2013.01)

(58) Field of Classification Search
CPC ..... H01H 9/302; H01H 9/32; H01H 9/34; H01H 9/341; H01H 9/345; H01H 33/7015;
(Continued)

(56) References Cited

U.S. PATENT DOCUMENTS 7,186,941 B2 * 3/2007 Yeon ..... H01H 9/346 218/15
7,748,105 B2 * 7/2010 Kinzler ..... H01H 71/0207 335/133
8,089,023 B2 * 1/2012 Kanno ..... C08L 23/02 218/150
8,237,074 B2 * 8/2012 Tetik ..... H01H 9/362 218/156
(Continued)

FOREIGN PATENT DOCUMENTS

CN 203250707 U 10/2013
CN 206363921 U 7/2017
(Continued)

OTHER PUBLICATIONS

International Search Report of PCT/CN2019/077966.
Written Opinion of PCT/CN2019/077966.

*Primary Examiner* — William A Bolton
(74) *Attorney, Agent, or Firm* — Dragon Sun Law Firm, PC; Jinggao Li, Esq.; Nathaniel Perkins

(57) ABSTRACT

The present invention provides an arc-extinguishing device, including an arc-extinguishing chamber, where the arc-extinguishing chamber includes a support, a plurality of arc-extinguishing grid sheets, a first gas-evolving hood, and a second gas-evolving hood; the plurality of arc-extinguishing grid sheets are mounted on the supports, the arc-extinguishing grid sheet has a groove to form a moving track
(Continued)

for a moving contact, both sides of the groove extend toward the moving contact respectively to form a first extension leg and a second extension leg, an end and an inner side of the first extension leg are wrapped by the first gas-evolving hood, and an end and an inner side of the second extension leg are wrapped by the second gas-evolving hood; a surface of the gas-evolving hood extending along the inner side of the extension leg toward the groove is referred to as a wrapping surface.

14 Claims, 6 Drawing Sheets

(58) Field of Classification Search
CPC .... H01H 33/42; H01H 73/18; H01H 71/0207; H01H 71/0235
USPC ..... 218/51, 15, 34, 37, 38, 46, 81, 26, 158
See application file for complete search history.

(56) References Cited

U.S. PATENT DOCUMENTS

| | | | | |
|---|---|---|---|---|
| 8,884,728 | B2 * | 11/2014 | Jang | H01H 77/108 335/201 |
| 9,006,601 | B2 * | 4/2015 | Zhou | H01H 9/443 218/148 |
| 9,396,890 | B2 * | 7/2016 | Smeltzer | H01H 9/36 |
| 9,673,004 | B1 * | 6/2017 | Ruempler | H01H 9/36 |
| 2007/0268100 | A1 * | 11/2007 | Schaltenbrand | H01H 9/34 335/201 |
| 2013/0284702 | A1 * | 10/2013 | Hamada | H01H 9/346 218/26 |

FOREIGN PATENT DOCUMENTS

| | | |
|---|---|---|
| CN | 207731889 U | 8/2018 |
| CN | 209104105 U | 7/2019 |

* cited by examiner

ARC-EXTINGUISHING DEVICE AND CIRCUIT BREAKER PROVIDED WITH SAME

CROSS-REFERENCE TO RELATED APPLICATIONS

This Application is a national stage application of PCT/CN2019/077966. This application claims priorities from PCT Application No. PCT/CN2019/077966, filed Mar. 13, 2019, and from the Chinese patent application 201811347327.0 filed Nov. 13, 2018, the content of which is incorporated herein in the entirety by reference.

TECHNICAL FIELD

The present invention relates to an arc-extinguishing device and a circuit breaker provided with the arc-extinguishing device.

BACKGROUND

At present, a circuit breaker is mainly composed of a contact system, an arc-extinguishing system, a housing, an operation mechanism and a release system. The contact system is mainly composed of a moving contact, a fixed contact, a moving contact point, a fixed contact point and an arcing horn, and the arc-extinguishing system is mainly composed of an arc-extinguishing grid sheet, a support, a flash barrier, and a gas-evolving hood. Because the existing circuit breaker does not take into account the cooperation between the arc-extinguishing system and the contact system during an arc extinguishing process, strong energy of a short circuit current will easily burn out the circuit breaker in case of occurrence of short-circuiting. In this way, the arc-extinguishing system and the contact system are required to cooperatively work to form an arc-extinguishing device with good performance so as to help the circuit breaker to successfully disconnect the short circuit current.

SUMMARY

In order to solve the problems existing in the prior art, the present invention provides an arc-extinguishing device and a circuit breaker provided with the arc-extinguishing device. In this case, the circuit breaker can more easily extinguish an electric arc.

On one hand, the present invention provides an arc-extinguishing device, including an arc-extinguishing chamber, where the arc-extinguishing chamber comprises a support, a plurality of arc-extinguishing grid sheets, a first gas-evolving hood, and a second gas-evolving hood; the plurality of arc-extinguishing grid sheets are mounted on the supports, the arc-extinguishing grid sheet has a groove to form a moving track for a moving contact, both sides of the groove extend toward the moving contact respectively to form a first extension leg and a second extension leg, an end and an inner side of the first extension leg are wrapped by the first gas-evolving hood, and an end and an inner side of the second extension leg are wrapped by the second gas-evolving hood; a surface of the gas-evolving hood extending along the inner side of the extension leg toward the groove is referred to as a wrapping surface, a front edge of the wrapping surface is aligned with or goes beyond a front end of the moving contact.

In an example of the present invention, the front edge of the wrapping surface is aligned with or even goes beyond the front end of the moving contact, so that a gas-evolving function is enabled. In this way, in a case of short-circuiting, electric arcs can be gathered to increase an arc voltage, thereby helping the circuit breaker to disconnect a short circuit current.

Preferably, a shape of the front edge of the wrapping surface is consistent with a moving trajectory of the front end of the moving contact, that is, the front edge of the wrapping surface keeps a basically same distance from the moving trajectory of the front end of the moving contact.

Furthermore, the front edge of the wrapping surface has a protrusion facing toward the inside of the groove of the arc-extinguishing grid sheet to form a necking structure for the moving contact, so as to better gather the electric arcs; a shape of the protrusion is consistent with the moving trajectory of the front end of the moving contact, that is, the protrusion keeps a basically same distance from the moving trajectory of the front end of the moving contact.

Furthermore, the arc-extinguishing device further includes the moving contact which is of rod shape, rotatable around a shaft and provided with a moving contact point, and the front end of the moving contact is movable along a track formed by the grooves of the plurality of arc-extinguishing grid sheets. Preferably, an insulation plate is connected at a position that is on the moving contact and behind the moving contact point, and the insulation plate is driven by the moving contact to move. In this case, an opening of a rear region of the arc-extinguishing device is reduced, so that the electric arc will more easily enter a front end of the arc-extinguishing device, i.e. an end of the arc-extinguishing grid sheet having no groove, rather than enter the end of the arc-extinguishing grid sheet having extension legs.

Furthermore, the arc-extinguishing device further includes a fixed contact, where the fixed contact is of U-shaped structure on which a fixed contact point is disposed.

Furthermore, the fixed contact further includes a magnetic conducting block disposed in the U-shaped structure. The magnetic conducting block can increase a magnetic field strength near the fixed contact to generate a larger magnetic blow force so as to blow the electric arc into the arc-extinguishing grid sheets of the arc-extinguishing chamber.

Further, the fixed contact further includes an insulation cover, where the insulation cover wraps the U-shaped structure to insulate the non-opening end of the U-shaped structure from the arc-extinguishing chamber because this region is easily broken down by electric arc. Preferably, the insulation cover is like a cap. In a preferred example of the present invention, a gap for exposing the fixed contact point may be disposed on the insulation cover.

On the other hand, the present invention provides a circuit breaker provided with the above arc-extinguishing device.

Specifically, the present invention provides a circuit breaker, including a housing, a moving contact, a fixed contact, and a arc-extinguishing device. The arc-extinguishing device includes an arc-extinguishing chamber, the arc-extinguishing chamber includes a support, a plurality of arc-extinguishing grid sheets, a first gas-evolving hood, and a second gas-evolving hood; the plurality of arc-extinguishing grid sheets are mounted on the supports, the arc-extinguishing grid sheet has a groove to form a moving track for a moving contact, both sides of the groove extend toward the moving contact respectively to form a first extension leg and a second extension leg, an end and an inner side of the first extension leg are wrapped by the first gas-evolving hood, and an end and an inner side of the second extension leg are wrapped by the second gas-evolving hood; a surface of the gas-evolving hood extending along the inner side of the extension leg toward the groove is referred to as a wrapping surface, a front edge of the wrapping surface is aligned with or goes beyond a front end of the moving contact.

Preferably, a shape of the front edge of the wrapping surface is consistent with a moving trajectory of the front end of the moving contact, that is, the front edge of the wrapping surface keeps a basically same distance from the moving trajectory of the front end of the moving contact.

Furthermore, the front edge of the wrapping surface has a protrusion facing toward the inside of the groove of the arc-extinguishing grid sheet to form a necking structure for the moving contact, so as to better gather the electric arcs; a shape of the protrusion is consistent with the moving trajectory of the front end of the moving contact, that is, the protrusion keeps a basically same distance from the moving trajectory of the front end of the moving contact.

The moving contact is of rod shape, rotatable around a shaft and provided with a moving contact point, and the front end of the moving contact is movable along a track formed by the grooves of the plurality of arc-extinguishing grid sheets. Preferably, an insulation plate is connected at a position that is on the moving contact and behind the moving contact point, and the insulation plate is driven by the moving contact to move. In this case, an opening of a rear region of the arc-extinguishing device is reduced, so that the electric arc will more easily enter the front end of the arc-extinguishing device, i.e. an end of the arc-extinguishing grid sheet having no groove, rather than enter the end of the arc-extinguishing grid sheet having extension legs.

The fixed contact is of U-shaped structure on which a fixed contact point is disposed.

Furthermore, the fixed contact further includes a magnetic conducting block which is disposed in the U-shaped structure. The magnetic conducting block can increase a magnetic field strength near the fixed contact to generate a larger magnetic blow force so as to blow the electric arc into the arc-extinguishing grid sheets of the arc-extinguishing chamber.

Furthermore, the fixed contact further includes an insulation cover wrapping the U-shaped structure to insulate the non-opening end of the U-shaped structure from the arc-extinguishing chamber because this region is easily broken down by electric arc. Preferably, the insulation cover is like a cap. In a preferred example of the present invention, a gap for exposing the fixed contact point is disposed on the insulation cover.

The term "front" used herein refers to a direction in which the moving contact points to the arc-extinguishing sheet, and the term "rear" used herein refers to a reverse direction.

The arc-extinguishing device and the circuit breaker provided with the arc-extinguishing device provided by the present invention have excellent arc-extinguishing performance, so that the electric arcs will be moved toward the arc-extinguishing grid sheets under the joint action of the magnetic blow force and the gas blow force and gathered by narrow channels defined by the gas-evolving hoods. In this way, the arc voltage will be increased to more effectively extinguish the electric arcs, thereby helping the circuit breaker to disconnect the short circuit current.

BRIEF DESCRIPTIONS OF THE DRAWINGS

Numerals of drawings are described as follows: 1. circuit breaker, 2. arc-extinguishing chamber, 21. arc-extinguishing grid sheet, 211. grid sheet rear end (211*a*. first extension leg, 211*b*. second extension leg), 212. grid sheet front end, 22. support (22*a*. left support, 22*b*. right support, 213. front edge, 214. rear edge), 3. gas-evolving hood (3*a*. first gas-evolving hood, 3*b*. second gas-evolving hood), 31. wrapping surface (31*a*. first wrapping surface, 31*b*. second wrapping surface); 32. protrusion (32*a*. first protrusion, 32*b*. second protrusion), 4. housing, 5. moving contact, 51. moving contact front end, 52. moving contact point, 6. fixed contact, 61. U-shaped structure, 62. fixed contact point, 7. insulation cover, 8. magnetic conducting block, 9. insulation plate.

DETAILED DESCRIPTIONS OF EMBODIMENTS

In order to fully understand the object, features and effects of the present invention, the concept, specific structure and technical effects of the present invention will be further described in combination with the accompanying drawings.

It is understood that in the descriptions of the present invention, orientation or positional relationship indicated by the terms "upper", "lower", "front", "rear", "left", "right", "top", "bottom", "inner", "outer", "vertical" and "horizontal" and the like is based on orientation or positional relationship shown in the accompanying drawings, and is used only for ease of descriptions and simplification rather than for indicating or implying that the indicated device or element must have a particular orientation, or be constructed and operated in a specific orientation and thus shall not be interpreted as limiting of the present invention.

Further, the terms "first" and "second" are used only for descriptions rather than understood as indicating or implying relative importance or implicitly indicating a number of the indicated technical features. Therefore, the features defined by "first" and "second" may explicitly or implicitly include one or more of the features.

In the present invention, unless otherwise indicated, the terms "mount", "connect", "couple", "fix" and the like shall be understood in a broad sense, which may include for example, fixed connection, detachable connection, or one-piece connection; mechanical connection, or electrical connection; direct connection or connection through an intermediate medium, and internal communication of two elements. Those skilled in the art may understand the specific meaning of the above terms according to the actual situations.

Example

Figure 1:
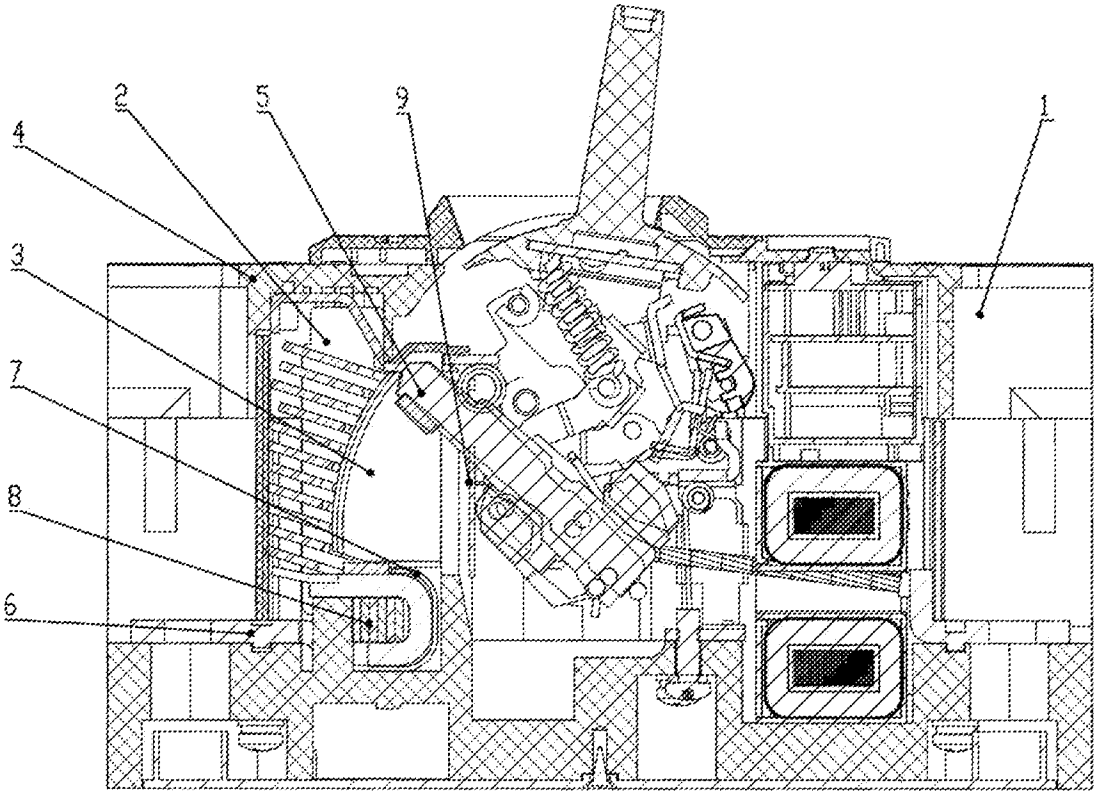
FIG. 1 is a structural schematic diagram of a circuit breaker according to a preferred example of the present invention.
Figure 2:
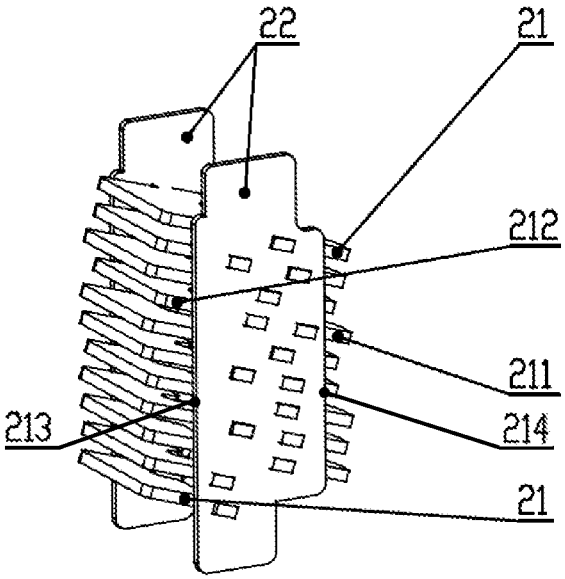
FIG. 2 is a schematic diagram of a front end structure of arc-extinguishing grid sheets inserted into supports according to an example of the present invention.
Figure 3:
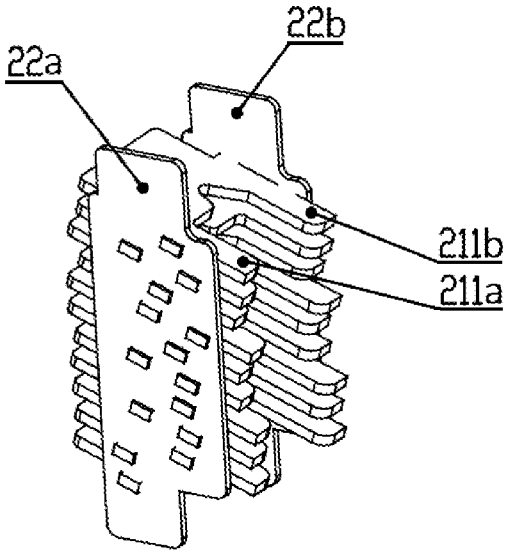
FIG. 3 is a structural schematic diagram of an extension leg end structure of arc-extinguishing grid sheets inserted into supports according to an example of the present invention.

As shown in FIGS. 1-3, an arc-extinguishing device used in a circuit breaker 1 of the present invention includes an arc-extinguishing chamber 2. The arc-extinguishing chamber 2 includes a support 22 (a left support 22*a* and a right support 22*b*), and a plurality of arc-extinguishing grid sheets 21, the plurality of arc-extinguishing grid sheets 21 are inserted into the supports 22, each arc-extinguishing grid sheet 21 has a front end 212 and a rear end 211, a groove is disposed at a side close to the rear end to divide the rear end 211 into a first extension leg 211*a* and a second extension leg 211*b*, and the grooves of the plurality of arc-extinguishing grid sheets form a moving track of a moving contact.

Figure 4:
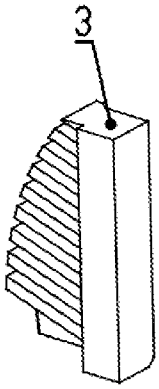
FIG. 4 is a schematic diagram of external structure of arc-extinguishing grid sheets with extension legs wrapped by a gas-evolving hood according to an example of the present invention.
Figure 5:
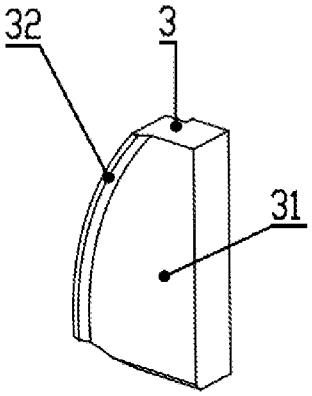
FIG. 5 is a schematic diagram of an internal structure of a gas-evolving hood wrapping extension legs of arc-extinguishing grid sheets according to an example of the present invention.
Figure 6:
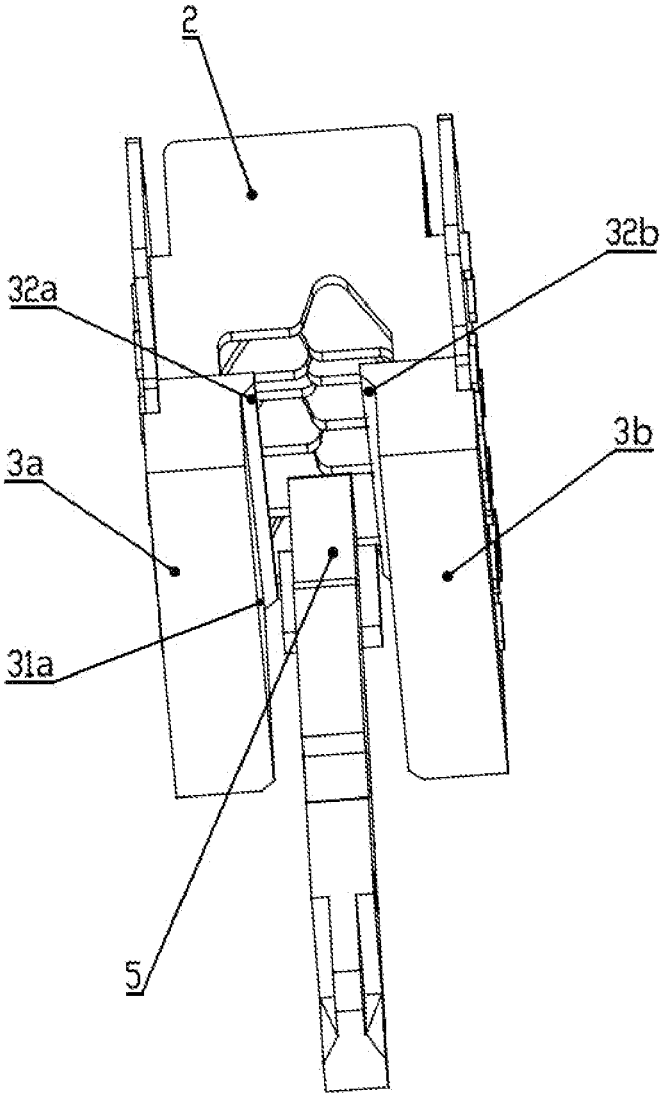
FIG. 6 is a top view of an arc-extinguishing device containing a moving contact according to an example of the present invention.
Figure 7:
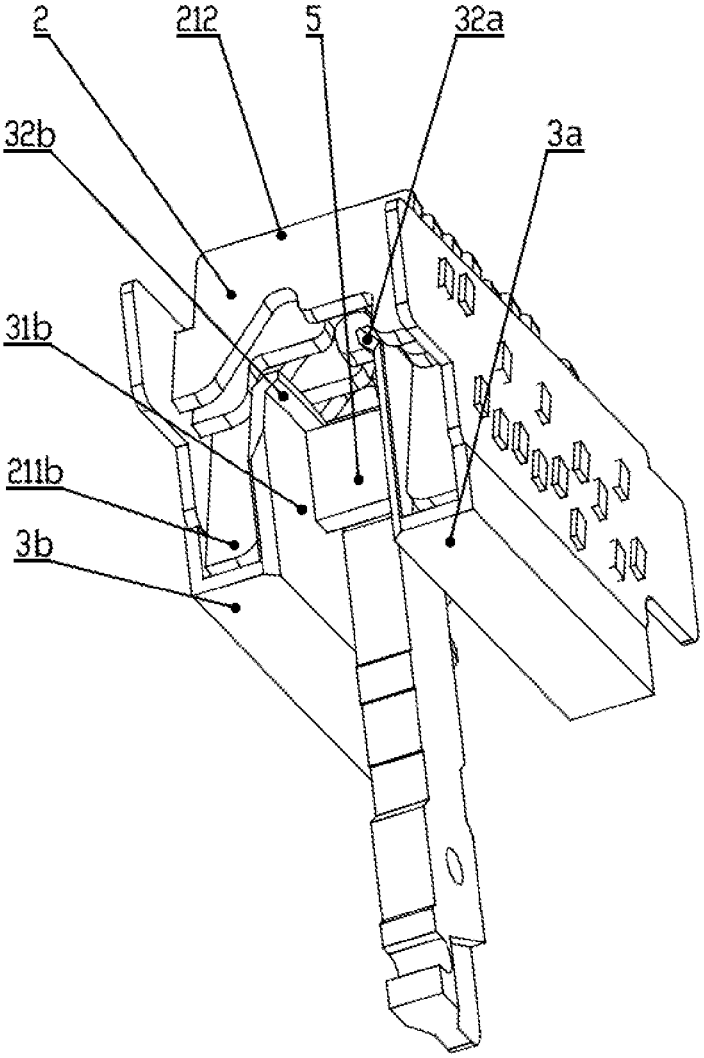
FIG. 7 is a bottom view of an arc-extinguishing device containing a moving contact according to an example of the present invention.

As shown in FIGS. 4 and 5, the arc-extinguishing device further includes a gas-evolving hood 3, and the gas-evolving hood is capable of generating gas under the action of electric arc when the circuit breaker 1 is in a short-circuit state; the gas-evolving hood includes a wrapping surface 31 and a protrusion 32, and an end and an inner side of the extension leg is wrapped by the gas-evolving hood 3. As shown in FIGS. 6 and 7, the gas-evolving hood 3 includes a left first gas-evolving hood 3*a* and a right second gas-evolving hood 3*b*, the first gas-evolving hood has a first wrapping surface 31*a* and a first protrusion 32*a* disposed at a front edge of the first wrapping surface 31*a*, and the second gas-evolving hood has a second wrapping surface 31*b* and a second protrusion 32*b* disposed at a front edge of the second wrapping surface 31*b*.

Figure 8:
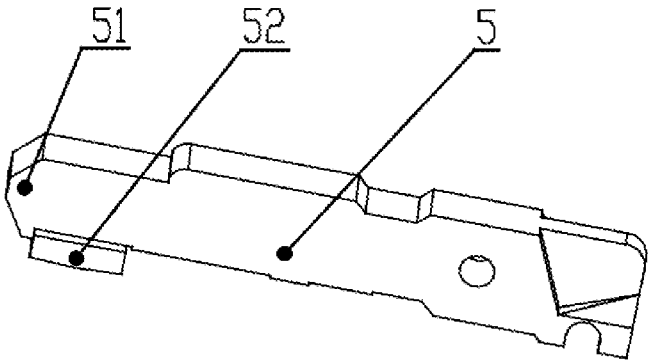
FIG. 8 is a structural schematic diagram of a moving contact according to an example of the present invention.

The circuit breaker or the arc-extinguishing device further includes a moving contact 5. As shown in FIG. 8, the moving contact 5 includes a front end 51 and a moving contact point 52. As shown in FIGS. 6 and 7, the front edge of the wrapping surface 31 is aligned with or goes beyond the front end 51 of the moving contact 5. In this example, the front edges of the wrapping surfaces 31*a* and 31*b* are protrusions 32*a* and 32*b*, both of which form a necking structure for the front end 51 of the moving contact, so that a moving space of the moving contact 5 formed by the gas-evolving hoods 3 is presented as changing from large to small. In the design of the present invention, the shape of the front edge of the wrapping surface 31 is consistent with a moving trajectory of the front end 51 of the moving contact 5, that is, the front edge of the wrapping surface 31 keeps a basically same distance from the moving trajectory of the front end 51 of the moving contact 5. In a case of short circuiting, the electric arcs can be gathered by the gas-evolving function. In the example, the effect of gathering the electric arcs is realized by the wrapping surface 31 and the protrusion 32.

Figure 9:
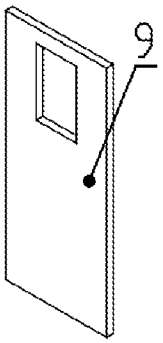
FIG. 9 is a structural schematic diagram of an insulation plate according to an example of the present invention.

As shown in FIG. 1, an insulation plate 9 is connected at a position that is on the moving contact 5 and behind the moving contact point 52. The insulation plate 9 has a structure as shown in FIG. 9. The insulation plate 9 can be driven by the moving contact 5 to move while the insulation plate basically maintains in a vertical state during movement. In this way, an opening at a rear region of the arc-extinguishing device, i.e. at the insulation plate 9, will be reduced, so that the electric arc will more easily enter the front end 212 of the arc-extinguishing grid sheet, rather than enter an opposite region behind the insulation plate 9.

Figure 10:
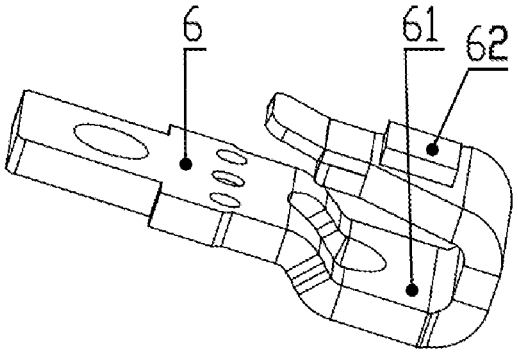
FIG. 10 is a structural schematic diagram of a fixed contact according to an example of the present invention.
Figure 11:
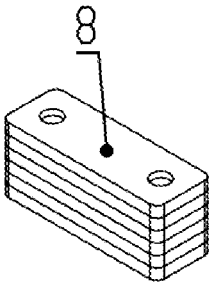
FIG. 11 is a structural schematic diagram of a magnetic conducting block according to an example of the present invention.
Figure 12:
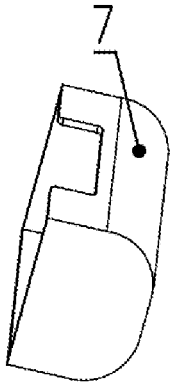
FIG. 12 is a structural schematic diagram of an insulation cover according to an example of the present invention.

As shown in FIGS. 1, 10 and 11, the circuit breaker 1 or the arc-extinguishing device further includes a fixed contact 6 and a magnetic conducting block 8. The fixed contact 6 is of U-shaped structure 61 in which the magnetic conducting block 8 is disposed. Further, a fixed contact point 62 is disposed on the U-shaped structure. An insulation cover 7 is further disposed at an end of the U-shaped structure. As shown in FIG. 12, the insulation cover is like a cap and has a gap for exposing the fixed contact point so as to facilitate contact with the moving contact point.

The above descriptions are made to the preferred examples of the present invention. It should be understood that those skilled in the art may make various modifications and changes according to the idea of the present invention without paying creative work. Therefore, all technical solutions obtained by those skilled in the art by performing logical analysis, inference and limited tests based on the idea of the present invention and the prior art shall fall within the scope of protection defined by the claims.

What is claimed is:

1. An arc-extinguishing device, comprising an arc-extinguishing chamber (2), wherein the arc-extinguishing chamber (2) comprises:

a left support (22*a*) and a right support (22*b*) parallel to the left support (22*a*);

a plurality of arc-extinguishing grid sheets (21), each of the plurality of arc-extinguishing grid sheets comprising a front end (212) and a rear end (211), wherein the front end (212) extends beyond front edges (213) of the left support (22*a*) and the right support (22*b*), and the rear end (211) extends beyond rear edges (214) of the left support (22*a*) and the right support (22*b*);

a groove disposed at a side close to the rear end to divide the rear end into a first extension leg (211*a*) and a second extension leg (211*b*); wherein grooves of the plurality of arc-extinguishing grid sheets form a moving track of a moving contact (5);

gas-evolving hoods (3) comprising a first gas-evolving hood (3*a*) and a second gas-evolving hood (3*b*), wherein the gas-evolving hoods (3) are configured to generate gas under an action of an electric arc when a circuit breaker (1) is in a short-circuit state, the first gas-evolving hood (3*a*) comprises a first wrapping surface (31*a*) and a first protrusion (32*a*) disposed at a front edge of the first wrapping surface (31*a*), the second gas-evolving hood (3*b*) comprises a second wrapping surface (31*b*) and a second protrusion (32*b*) disposed at a front edge of the second wrapping surface (31*b*), the first protrusion (32*a*) and the second protrusion (32*b*) form a necking structure for a front end (51) of the moving contact (5), the necking structure is configured for enhanced gathering of electric arcs, and a shape of the necking structure is consistent with a moving trajectory of the front end (51) of the moving contact (5);

wherein the plurality of arc-extinguishing grid sheets are mounted on the left support (22*a*) and the right support (22*b*), the first extension leg (211*a*) comprises a first end and a first inner side toward the groove; the first end and the first inner side of the first extension leg (211*a*) are entirely wrapped by the first gas-evolving hood, the second extension leg (211*b*) comprises a second end and a second inner side toward the groove; the second end and the second inner side of the second extension leg (211*b*) are entirely wrapped by the second gas-evolving hood; the first wrapping surface (31*a*) comprises a surface of the first gas-evolving hood extending along the first inner side of the first extension leg toward the groove; the second wrapping surface (31*b*) comprises a surface of the second gas-evolving hood extending along the second inner side of the second extension leg toward the groove, a front edge of the first wrapping surface and a front edge of the second wrapping surface are aligned with or goes beyond the front end (51) of the moving contact (5), and a shape of the front edge of the first wrapping surface and a shape of the front edge of the second wrapping surface are consistent with the moving trajectory of the front end of the moving contact.

2. The arc-extinguishing device according to claim 1, wherein the arc-extinguishing device further comprises the moving contact, and the moving contact is of rod shape, rotatable around a shaft and provided with a moving contact point.

3. The arc-extinguishing device according to claim 2, wherein an insulation plate (9) is connected at a position that is on the moving contact (5) and behind the moving contact point (52), and the insulation plate (9) is driven by the moving contact (5) to move while maintaining a vertical state during movement;

wherein the insulation plate (9) is configured to reduce an opening at a rear region of the arc-extinguishing device to facilitate entrance of the electric arc at the front end (212) of the plurality of arc-extinguishing grid sheets (21).

4. The arc-extinguishing device according to claim 1, wherein the arc-extinguishing device further comprises a fixed contact which is of U-shaped structure and a fixed contact point is disposed on the U-shaped structure.

5. The arc-extinguishing device according to claim 4, wherein the fixed contact further comprises a magnetic conducting block disposed in the U-shaped structure.

6. The arc-extinguishing device according to claim 4, wherein the fixed contact further comprises an insulation cover wrapping a non-opening end of the U-shaped structure.

7. The arc-extinguishing device according to claim 1, wherein the groove of each of the plurality of arc-extinguishing grid sheets (21) comprises a triangular notch at the rear end (211) of each of the plurality of arc-extinguishing grid sheets (21) between the first inner side and the second inner side, and each triangular notch alternates between a right side of the rear end (211) of each of the plurality of arc-extinguishing grid sheets (21) and a left side of the rear end (211) of each of the plurality of arc-extinguishing grid sheets (21).

8. A circuit breaker, comprising a housing, a moving contact, a fixed contact and an arc-extinguishing device, wherein the arc-extinguishing device comprises an arc-extinguishing chamber (2), the arc-extinguishing chamber (2) comprises:

a left support (22*a*) and a right support (22*b*) parallel to the left support (22*a*);

a plurality of arc-extinguishing grid sheets (21), each of the plurality of arc-extinguishing grid sheets comprising a front end (212) and a rear end (211), wherein the front end (212) extends beyond front edges (213) of the left support (22*a*) and the right support (22*b*), and the rear end (211) extends beyond rear edges (214) of the left support (22*a*) and the right support (22*b*);

a groove disposed at a side close to the rear end to divide the rear end into a first extension leg (211*a*) and a second extension leg (211*b*); wherein grooves of the plurality of arc-extinguishing grid sheets form a moving track of the moving contact (5);

gas-evolving hoods (3) comprising a first gas-evolving hood (3*a*) and a second gas-evolving hood (3*b*), wherein the gas-evolving hoods (3) are configured to generate gas under an action of an electric arc when the circuit breaker (1) is in a short-circuit state, the first gas-evolving hood (3*a*) comprises a first wrapping surface (31*a*) and a first protrusion (32*a*) disposed at a front edge of the first wrapping surface (31*a*), the second gas-evolving hood (3*b*) comprises a second wrapping surface (31*b*) and a second protrusion (32*b*) disposed at a front edge of the second wrapping surface (31*b*), the first protrusion (32*a*) and the second protrusion (32*b*) form a necking structure for a front end (51) of the moving contact (5), the necking structure is configured for enhanced gathering of electric arcs, and a shape of the necking structure is consistent with a moving trajectory of the front end (51) of the moving contact (5);

wherein the plurality of arc-extinguishing grid sheets are mounted on the left support (22*a*) and the right support (22*b*), the first extension leg (211*a*) comprises a first end and a first inner side toward the groove; the first end and the first inner side of the first extension leg (211*a*) are entirely wrapped by the first gas-evolving hood, the second extension leg (211*b*) comprises a second end and a second inner side toward the groove; the second end and the second inner side of the second extension leg (211*b*) are entirely wrapped by the second gas-evolving hood; the first wrapping surface (31*a*) comprises a surface of the first gas-evolving hood extending along the first inner side of the first extension leg toward the groove; the second wrapping surface (31*b*) comprises a surface of the second gas-evolving hood extending along the second inner side of the second extension leg toward the groove, a front edge of the first wrapping surface and a front edge of the second wrapping surface are aligned with or goes beyond the front end (51) of the moving contact (5), and a shape of the front edge of the first wrapping surface and a shape of the front edge of the second wrapping surface are consistent with the moving trajectory of the front end of the moving contact.

9. The circuit breaker according to claim 8, wherein the moving contact is of rod shape, rotatable around a shaft and provided with a moving contact point, and the front end of the moving contact is movable along a track formed by the grooves of the plurality of arc-extinguishing grid sheets.

10. The circuit breaker according to claim 9, wherein an insulation plate (9) is connected at a position that is on the moving contact (5) and behind the moving contact point (52), and the insulation plate (9) is driven by the moving contact (5) to move while maintaining a vertical state during movement;

wherein the insulation plate (9) is configured to reduce an opening at a rear region of the arc-extinguishing device to facilitate entrance of the electric arc at the front end (212) of the plurality of arc-extinguishing grid sheets (21).

11. The circuit breaker according to claim 8, wherein the fixed contact is of U-shaped structure on which a fixed contact point is disposed.

12. The circuit breaker according to claim 11, wherein the fixed contact further comprises a magnetic conducting block disposed in the U-shaped structure.

13. The circuit breaker according to claim 11, wherein the fixed contact further comprises an insulation cover wrapping a non-opening end of the U-shaped structure.

14. The circuit breaker according to claim 8, wherein the groove of each of the plurality of arc-extinguishing grid sheets (21) comprises a triangular notch at the rear end (211) of each of the plurality of arc-extinguishing grid sheets (21) between the first inner side and the second inner side, and each triangular notch alternates between a right side of the rear end (211) of each of the plurality of arc-extinguishing grid sheets (21) and a left side of the rear end (211) of each of the plurality of arc-extinguishing grid sheets (21).

* * * * *